United States Patent [19]

Doerner

[11] 4,014,086

[45] Mar. 29, 1977

[54] SAFETY FEATURE FOR CHAIR CONTROLS

[76] Inventor: Frank Doerner, 138 Aberdeen Road, Kitchener, Ontario, Canada

[22] Filed: Aug. 4, 1976

[21] Appl. No.: 711,542

[52] U.S. Cl. ..... 297/303; 297/305; 248/381

[51] Int. Cl.[2] ..... A47C 3/026

[58] Field of Search ..... 297/301–305; 248/378–381

[56] References Cited

UNITED STATES PATENTS

| | | | |
|---|---|---|---|
| 756,955 | 4/1904 | Germanson | 248/380 |
| 1,282,035 | 10/1918 | Bolens | 248/380 |
| 2,845,992 | 8/1958 | Cramer | 297/303 |
| 3,368,844 | 2/1968 | Doerner | 297/303 |
| 3,741,607 | 6/1973 | Cramer | 297/305 |

*Primary Examiner*—Francis K. Zugel
*Attorney, Agent, or Firm*—George H. Riches and Associates

[57] ABSTRACT

This invention discloses a novel safety feature to be used in conjunction with chair controls of tiltable chairs. The chair controls used in the present invention include a biasing means which comprises a horizontal bolt (whose shaft includes a sheath thereon) extending from inside the fixed frame portion through the moveable frame portion of the chair control and marginally beyond, a tension means to create tension in the biasing means and a tension control means adapted to control the tension in the tension means, whereby the biasing means is adapted to return the tilted portion of the chair to a position of rest when the tilting pressure is released. The safety feature comprises a downwardly depending plate on the front edge of the moveable frame portion of the chair control with an arch shaped aperture centrally therein through which the biasing means extends and a pair of ears on opposite sides of the sheath on the bolt of the biasing means in the moveable frame portion with a loosely fitted washer on the sheath between the plate and the ears. If the bolt breaks during operation, the bolt will project forward and the ears strike the washer which will then only project forward as far as the plate. The biasing means then drops harmlessly to the floor. This safety feature will prevent injury to the user of the chair or to the furniture situated in front of the chair should the bolt of the biasing means break during operation.

6 Claims, 4 Drawing Figures

SAFETY FEATURE FOR CHAIR CONTROLS

BACKGROUND OF THE INVENTION

1. Field of the Invention

This invention relates generally to chair controls for tiltable chairs and more particularly, to a safety feature for use with chair controls on tiltable chairs.

2. Description of the Prior Art

Tiltable chairs of the prior art generally consist of a back portion, a seat portion, a chair control and a base portion. The chair control pivotally connects the base portion of the chair to the seat portion and allows the tilting of a part of the chair in a rearwards and backwards direction when rearward pressure is applied to the back portion of the chair by the user thereof. The chair control is adapted to return the tilting portion of the chair to a resting position when this pressure is released.

These chair controls consist essentially of a fixed frame portion secured to the base portion of the chair, a moveable frame portion secured to the tilting portion of the chair (either the seat or the back of the chair) and a biasing means which pivotally connects the fixed frame portion to the moveable frame portion thereby allowing the seat or the back of the chair to be tilted.

The biasing means usually comprises an elongated bolt which extends from the interior of the fixed frame portion through the moveable frame portion and marginally beyond. The head of the bolt is placed in the fixed frame portion and a slot or groove is provided in the vertical wall of the fixed frame portion in which the head of the bolt may pivot. The shaft of the bolt extends through the fixed frame portion, through the length of the moveable frame portion and marginally beyond.

A helical spring is inserted on that portion of the bolt within the moveable frame portion and the interior end of this spring contacts with the interior vertical wall of the moveable frame portion. A tension control means is inserted on the free end of the bolt. This tension control means usually comprises a pressure plate in contact with the spring, a short sheath about the bolt and affixed to the pressure plate and extending outwards to a handwheel. The interior of the sheath is screw-threaded corresponding to the screw-threading on the end of the bolt.

In order to create tension in the spring, the handwheel is tightened thereby causing the pressure plate to move inwards contracting the helical spring. Thus, by moving the position of the handwheel, the amount of tension in the spring may be increased or reduced.

When the user of the chair applies rearward pressure to the back portion of the chair, the bolt pivots on its head in the corresponding slot in the fixed frame portion and the moveable frame portion moves upward thereby causing the seat and back portions of the chair to tilt rearwards. The tension in the helical spring will cause the device to pivot back on the head of the bolt and thus return the tilted portion of the chair to the resting position once the user of the chair releases the rearward pressure.

However, a serious safety problem occurs if the bolt of the biasing means should break. If the bolt should break at any point between the head of the bolt and the handwheel, the peripheral end of the bolt and the tension control means will project forward possibly causing severe damage to the user of the chair or any piece of furniture situated in front of the chair. Realizing that the helical spring of the biasing means is under constant tension and the amount of frictional wear on the head of the bolt, it has been found that many of the bolts will break after a period of use of the chair. This presents a serious danger to the user of the chair as the user's legs are normally directly in front of the tension control means and certainly in its path should it project forward. Also, if the operator of the chair is not directly in front of the tension control means, there is usually a piece of furniture in front of the chair and the tension control means would severely damage this furniture in this forward path.

SUMMARY OF THE INVENTION

Accordingly, it is an object of the present invention to at least partially overcome these disadvantages by providing a novel safety feature affixed to the peripheral surface of the sheath of a tension control means of a chair control in conjunction with an overhanging downwardly depending plate affixed to the moveable frame portion of the chair control.

To this end, in one of the aspects, the invention provides an improved chair control for tiltable chairs wherein a portion of the chair tilts rearward and downward when rearward pressure is applied to the back portion of the chair, the chair control comprising a fixed frame portion secured to the base portion of the chair, a moveable frame portion affixed to the undersurface of the seat portion of the chair and pivotally connected to the fixed frame portion, a biasing means adapted to return the moveable frame portion to a position of rest when the rearward pressure is released from the back portion of the chair, the biasing means comprising an elongated bolt with its head pivotally within the fixed frame portion and the shaft of the bolt extending through the moveable frame portion and marginally beyond, a helical spring inserted on the shaft of the bolt within the moveable frame portion, and a tension control means affixed to the peripheral end of the bolt, the tension control means comprising a pressure plate placed proximate the terminal end of the helical spring, a sheath encasing the shaft of the bolt from the pressure plate to the free end of the bolt and affixed to the pressure plate, the interior of said sheath being screw-threaded correspondingly to the peripheral end of the bolt, and a handwheel affixed to the end of the sheath exterior to the moveable frame portion, the tension control means adapted to control the tension in the helical spring, the improvement comprising the moveable frame portion having a downwardly depending plate on its front surface with an arch-shaped aperture centrally therein through which the sheath of the tension control means and the bolt of the biasing means extend and the sheath of the tension control means having a pair of small ears on opposite sides thereof proximate the pressure plate and a loosely fitting washer fitted around the sheath between the downwardly depending plate of the moveable frame portion and the ears.

BRIEF DESCRIPTION OF THE DRAWINGS

Further objects and advantages of the invention will appear from the following description taken together with the accompanying drawings in which.

DESCRIPTION OF THE PREFERRED EMBODIMENT

Figure 1:
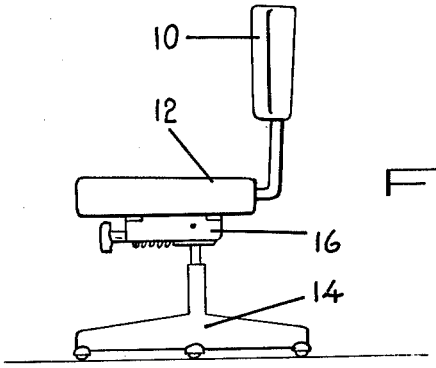
FIG. 1 is a side view of a tiltable chair.

Reference is first made to FIG. 1 which shows a tiltable chair comprising a back portion 10, a seat portion 12, a base portion 14 and a chair control shown generally as 16.

Figure 2:
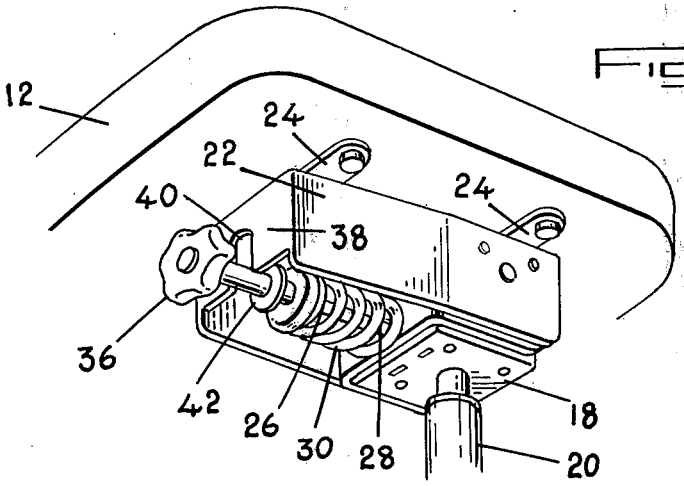
FIG. 2 is an underneath perspective view of a chair control embodying the present invention.
Figure 3:
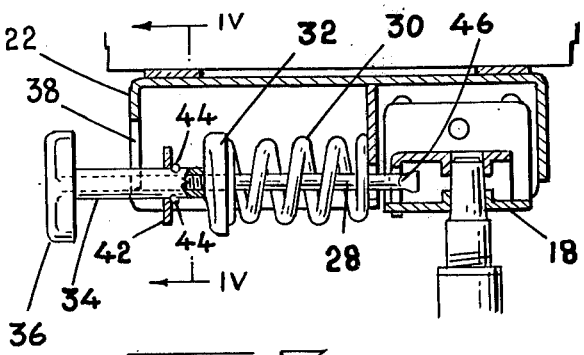
FIG. 3 is a side sectional view of a chair control of FIG. 2.
Figure 4:
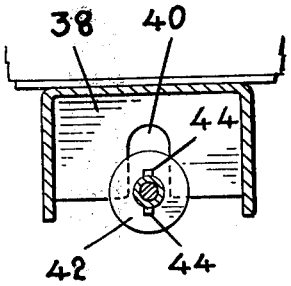
FIG. 4 is an end view through line IV—IV of FIG. 3.

As shown in FIG. 2, the chair control 16 comprises a fixed frame portion 18 rotatably secured to a vertical post 20, a moveable frame portion 22 secured by brackets 24 to the undersurface of seat portion 12. Biasing means 26 comprises an elongated bolt 28 extending from the inside of fixed frame portion 18 (see FIG. 3) through the moveable frame portion 22 to the front thereof. A helical spring 30 is inserted on an elongated bolt 28 inside the moveable frame portion 22 and pressure plate 32 is placed over the bolt to engage the opposite end of the helical spring 30. A sheath 34 extends from the pressure plate 32 to a handwheel 36 and is permanently affixed to both.

The interior of the sheath is screw-threaded corresponding to the screw-threading on the peripheral end of the bolt 28. Thus, when the handwheel 36 is tightened, the pressure plate 32 compresses the spring 30 increasing the tension therein. When the handwheel 36 is loosened, the pressure plate 32 moves outward thereby allowing the spring to expand and releasing the tension therein.

The tension in the helical spring 30 causes the chair seat 12 to return to the resting position as shown in FIG. 1 after the rearward pressure is released by the user of the chair. The user may control the amount of force required to tilt the chair backwards by adjusting the tension in the spring 30 by loosening or tightening the handwheel 36. In order to return the chair to the resting position, a sufficient amount of tension must be maintained in the spring, this tension being sufficient to propel the bolt forward with a large velocity should it break during operation.

The inventor has invented a safety feature to prevent injury to the user of the chair or any furniture which is directly in front of the chair should the bolt break during operation. The first aspect of the safety feature is a downwardly depending plate 38 placed on the front of the moveable frame portion. The height of the plate 38 is approximately equal to the height of the moveable frame portion and the plate contains an arch-shaped aperture indicated as 40 centrally therein.

In conjunction therewith, the sheath of the tension control means carries a loose fitting washer 42 between the plate 38 and the pressure plate 32. A pair of ears 44 are affixed to the opposite sides of the sheath between the washer 42 and the pressure plate 32.

Should the bolt 28 break during operation, the tension in the compressed spring will propel the bolt forward. However, the washer 42 will strike the plate 38 and will be held stationary. As the bolt continues to move forward, the ears 44 will strike the rear surface of the washer 42 which is being held against the plate 38 thus preventing the bolt from advancing any further. The bolt and sheath will then drop harmlessly to the floor preventing any injury to the user of the chair or damage to the furniture which would have been struck by the handwheel 36 if the device had been allowed to project forward.

The diameter of the sheath 34 in chair controls is usually about five/eights of an inch (0.625 inches). It has been found that a washer with an outer diameter of approximately 1.5 inches and an inner diameter of approximately 0.635 inches is satisfactory. This allows the washer to move freely along the sheath 34 but not large enough to rattle and create considerable noise during operation of the chair.

The ears 44 affixed to the sheath may be about 3/16 inches in height and may be of any suitable shape, including but not restricted to square or round. The ears may be stamped out during manufacture of this sheath in a conventional means.

The width of the arch of the plate 38 must be less than the diameter of the washer and sufficiently less not to cause the washer to break when struck thereby.

The improved chair control provides protection when the chair is in the tilted position and also when the chair is in the resting position. When the chair back 10 is tilted rearward, the bolt 28 pivots about its head 46 and the bolt and the moveable frame portion both pivot together. Thus, the safety feature is operative when the chair is both in the resting or the tilted position.

Although the disclosure describes and illustrates a preferred embodiment of the invention, it is to be understood that the invention is not restricted to these particular embodiments.

The embodiments of the invention in which an exclusive property or privilege is claimed are defined as follows:

1. In a chair control for a tiltable chair wherein a portion of the chair tilts rearward and downward when rearward pressure is applied to the back portion of the chair, said chair control comprising a fixed frame portion secured to the base portion of the chair, a moveable frame portion affixed to the undersurface of the seat portion of the chair and pivotally connected to said fixed frame portion, a biasing means adapted to return said moveable frame portion to a position of rest when the rearward pressure is released from the back portion of the chair, said biasing means comprising an elongated bolt with its head pivotally within said fixed frame portion and the shaft of said bolt extending through the moveable frame portion and marginally beyond, a helical spring inserted on the shaft of the bolt within the moveable frame portion, and a tension control means affixed to the peripheral end of the bolt, said tension control means comprising a pressure plate placed proximate the terminal end of the helical spring, a sheath encasing said elongated bolt between the pressure plate and the free end of the bolt and affixed to the pressure plate, the interior of said sheath being screw-threaded correspondingly to the peripheral end of said bolt, and a handwheel affixed to the end of the sheath exterior to the moveable frame portion, said tension control means adapted to control the tension in the helical spring, the improvement comprising the moveable frame portion having a downwardly depending plate on its front surface with an arch-shaped aperture centrally therein through which the sheath of the tension control means and the bolt of the biasing means extend and the sheath of the tension control means having a pair of ears on opposite sides thereof proximate said pressure plate, and a loosely fitting washer fitted around said sheath between the downwardly depending plate of the moveable frame portion and said ears.

2. The chair control as claimed in claim 1 wherein said ears are square-shaped.

3. The chair control as claimed in claim 1 wherein said ears are round-shaped.

4. The chair control as claimed in claim 1 wherein the height of said ears is approximately 3/16 inches.

5. The chair control as claimed in claim 1 wherein the height of said downwardly depending plate on the front surface of the moveable frame portion is at least equal to the height of said moveable frame portion.

6. A chair control for use with tiltable chairs wherein the seat and back portion of the chair is tiltable rearward and downward when rearward pressure is applied to the back portion of the chair, said chair control comprising a fixed frame portion secured to a cylindrical post, a moveable frame portion affixed to the undersurface of the seat portion of the chair and pivotally connected to said fixed frame portion and having a downwardly depending plate on its front surface with an arch-shaped aperture centrally therein, a biasing means adapted to return said moveable frame portion to a position of rest when the rearward pressure is released from the back portion of the chair, said biasing means comprising an elongated bolt with its head pivotally within said fixed frame portion and the shaft of said bolt extending through the moveable frame portion and marginally beyond, a helical spring inserted on the shaft of the bolt within the moveable frame portion, and a tension control means affixed to the peripheral end of the bolt, said tension control means comprising a pressure plate placed proximate the terminal end of the helical spring, a sheath encasing said elongated bolt between the pressure plate and free end of the bolt and affixed to the pressure plate, the interior of said sheath being screw-threaded corresponding to the peripheral end of the bolt, and extending through the aperture of the plate on the moveable frame portion, said sheath having a pair of ears on opposite sides thereof proximate said pressure plate and carrying a loosely fitting washer fitted around said sheath between the downward depending plate of the moveable frame portion and said ears a handwheel affixed to the end of the sheath exterior to the moveable frame portion, said tension control means adapted to control the tension in the helical spring.

* * * * *